US006245391B1

(12) United States Patent
Kawai et al.

(10) Patent No.: US 6,245,391 B1
(45) Date of Patent: Jun. 12, 2001

(54) POWDER FLUIDIZED BED AND COATING METHOD UTILIZING A CIRCULATING POWDER STREAM

(75) Inventors: Hiroki Kawai; Masahiro Yamamoto, both of Tokyo (JP)

(73) Assignee: Nihon Parkerizing Co., Ltd., Tokyo (JP)

( * ) Notice: Subject to any disclaimer, the term of this patent is extended or adjusted under 35 U.S.C. 154(b) by 0 days.

(21) Appl. No.: 09/367,488

(22) PCT Filed: Dec. 21, 1998

(86) PCT No.: PCT/JP98/05777

§ 371 Date: Aug. 17, 1999

§ 102(e) Date: Aug. 17, 1999

(87) PCT Pub. No.: WO99/33574

PCT Pub. Date: Jul. 8, 1999

(30) Foreign Application Priority Data

Dec. 25, 1997 (JP) ..... 9-357588

(51) Int. Cl.[7] ..... B05D 1/24

(52) U.S. Cl. ..... 427/459; 427/475; 427/478; 427/485; 118/634; 118/DIG. 5

(58) Field of Search ..... 427/185, 459, 427/460, 475, 477, 478, 479, 485; 118/DIG. 5, 634

(56) References Cited

U.S. PATENT DOCUMENTS 3,828,729 * 8/1974 Goodridge .
3,905,785 * 9/1975 Fabre .
4,207,833 * 6/1980 Napadow .
4,301,764 * 11/1981 Campion et al. .
4,354,451 * 10/1982 Vohringer et al. .
5,056,460 * 10/1991 Vohringer .

FOREIGN PATENT DOCUMENTS 63-274465 * 11/1988 (JP) .
5-308709 * 11/1993 (JP) .

* cited by examiner

*Primary Examiner*—Fred J. Parker
(74) *Attorney, Agent, or Firm*—Wenderoth, Lind & Ponack, L.L.P.

(57) ABSTRACT

This invention pertains to a powder coating apparatus and a method for using the powder coating apparatus. The apparatus includes a booth that defines a coating space, a holder to hold an object within the coating space, electrodes positioned within the coating space, a power supplier to supply a voltage between the electrodes, a coating material blower to blow powder coating material into the coating space, and structure to form a circulating stream of the powder coating material within the coating space. The method includes blowing powder coating material into the coating space, whereby an object held by the holder becomes coated with the powder coating material. While the powder coating material is being blown into the coating space air is also blown in the coating space, whereby the powder coating material is carried in a stream that flows along the object in a first direction and then along the electrodes in an opposite second direction.

23 Claims, 4 Drawing Sheets

POWDER FLUIDIZED BED AND COATING METHOD UTILIZING A CIRCULATING POWDER STREAM

TECHNICAL FIELD

The present invention relates to a powder coating apparatus and a powder coating method, and more particularly, to an apparatus and a method therefor in which a powder coating is performed using an electrostatic fluidized dipping method.

BACKGROUND ART

From the viewpoint of environmental preservation, attention is paid to ecofriendly, pollution-free type powder coating that uses no solvents. One of such powder coating methods is an electrostatic fluidized dipping method. In the electrostatic fluidized dipping method, a tank for storing a powder coating material is formed at a lower portion of a substantially closed booth, and air is blown into the storage tank to thereby cause the charged powder coating material to fly up within the booth. Then, in such an atmosphere, an electrically grounded object to be coated is introduced above the storage tank, and the powder coating material is caused to adhere onto the surface of the object to be coated by an electrostatic force.

According to this method, coating is carried out within the booth, and thus powder coating can be performed on the surface of the object to be coated while preventing the splashing and adhesion of the powder coating material onto peripheral equipment, etc., arranged outside the booth.

However, since fluctuation of particle diameter occurs in the powder coating material, finer particles are easily blown up while particles having larger sizes are hardly blown up. Since the particles of the coating material are thus classified, those particles having such a large size so as not to be blown up from the storage tank located in the lower portion of the booth to the object to be coated do not contribute to the formation of a film on the surface of the object to be coated. Therefore, there is a problem inherent in the conventional method that the use efficiency of the coating material was lowered.

DISCLOSURE OF THE INVENTION

The present invention has been made to overcome the aforementioned problem and therefore has as an object to provide a powder coating apparatus and a method therefor with which the use efficiency of a powder coating material can be improved.

A powder coating apparatus according to the present invention comprises: a booth; a fluidized bed of a powder coating material formed on the bottom of the booth and having an opening on the top thereof; coating material blowing structure for introducing the powder coating material from the fluidized bed and blowing the introduced powder coating material into the booth from an upper portion of the booth; holding structure for holding an object to be coated within the booth; electrodes provided within the booth so as to confront the object to be coated held by the holding structure; a power supply for applying a high voltage between the electrodes and the object to be coated; and circulating stream forming structure for forming a circulating stream of the powder coating material within the booth.

The fluidized bed may be detachably attached to the booth. Further, the circulating stream forming structure may have ejectors for blowing air upward from a lower portion of the booth. Still further, a rectifying unit for rectifying a stream of the powder coating material may be arranged immediately above the fluidized bed.

The powder coating apparatus may also have such a structure that the booth has openings at both ends in the longitudinal direction thereof, and the holding structure holds the object to be coated while moving the object to be coated in the longitudinal direction of the booth so that the object to be coated is allowed to pass through the booth via the openings at both ends, and the holding structure electrically grounds the object to be coated. In this case, the powder coating apparatus may further comprise sucking structure for sucking air from the openings at both ends in the longitudinal direction of the booth, and a bag filter for capturing the powder coating material contained in the air sucked by the sucking structure.

A powder coating method according to the present invention comprises the steps of: fluidizing a powder coating material on the bottom of a booth; introducing the fluidized powder coating material to blow the introduced powder coating material into the booth from an upper portion of the booth; introducing an object to be coated into the booth; forming an electric field for inducing the powder coating material around the object to be coated; and forming a circulating stream of the powder coating material within the booth.

The powder coating method may further comprise the step of passing the object to be coated through the booth by moving the object to be coated in the longitudinal direction of the booth. In this case, air may be sucked from an entrance and an exit for the object to be coated which are provided at both ends in the longitudinal direction of the booth to thereby entrap the powder coating material contained in the sucked air.

BEST MODE FOR CARRYING OUT THE INVENTION

Embodiments of the present invention will now be described with reference to the accompanying drawings.

Figure 1:
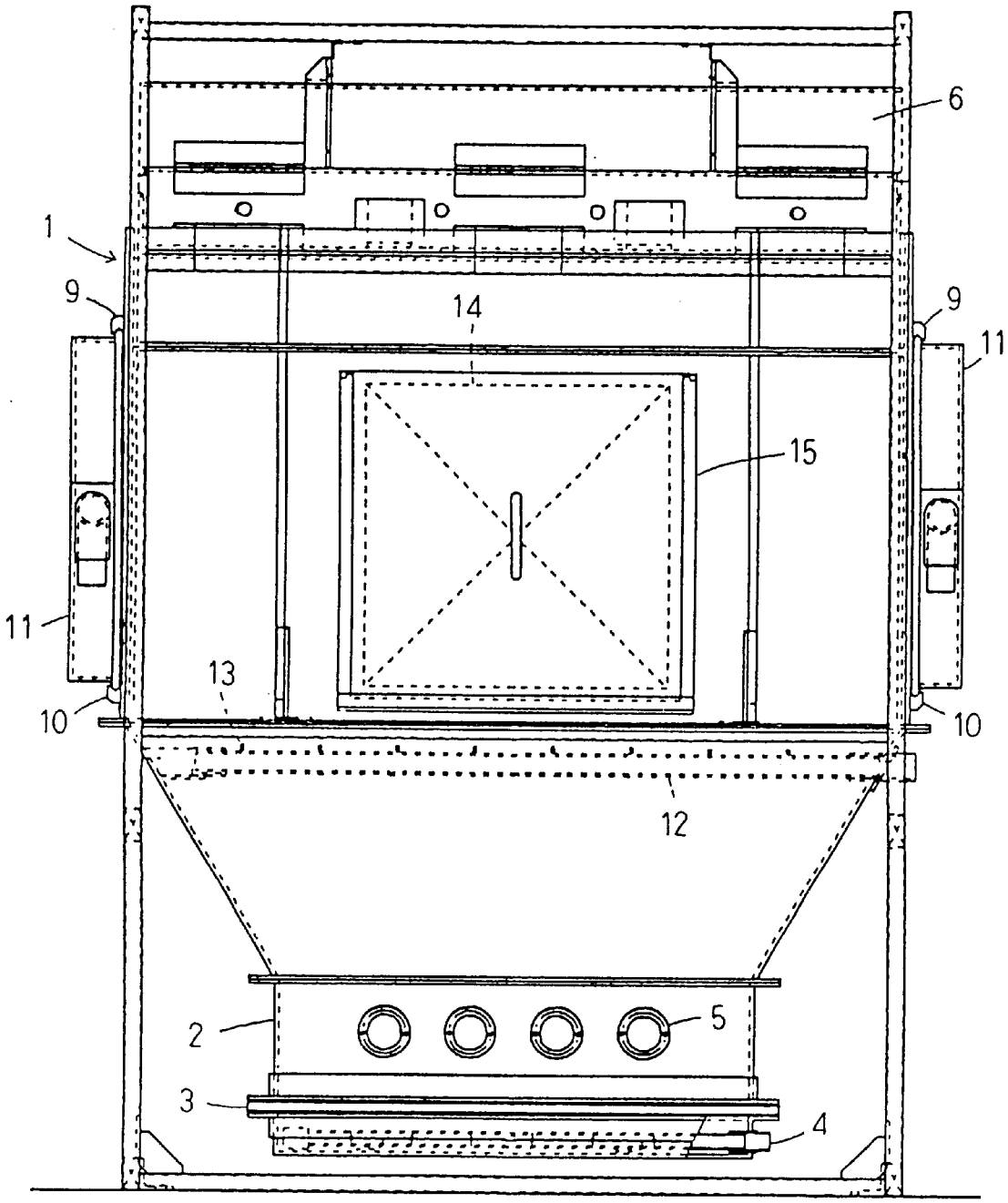
FIGS. 1 to 3 are a front view, a side view and a plan view, respectively, each showing a powder coating apparatus according to an embodiment of the present invention.
Figure 2:
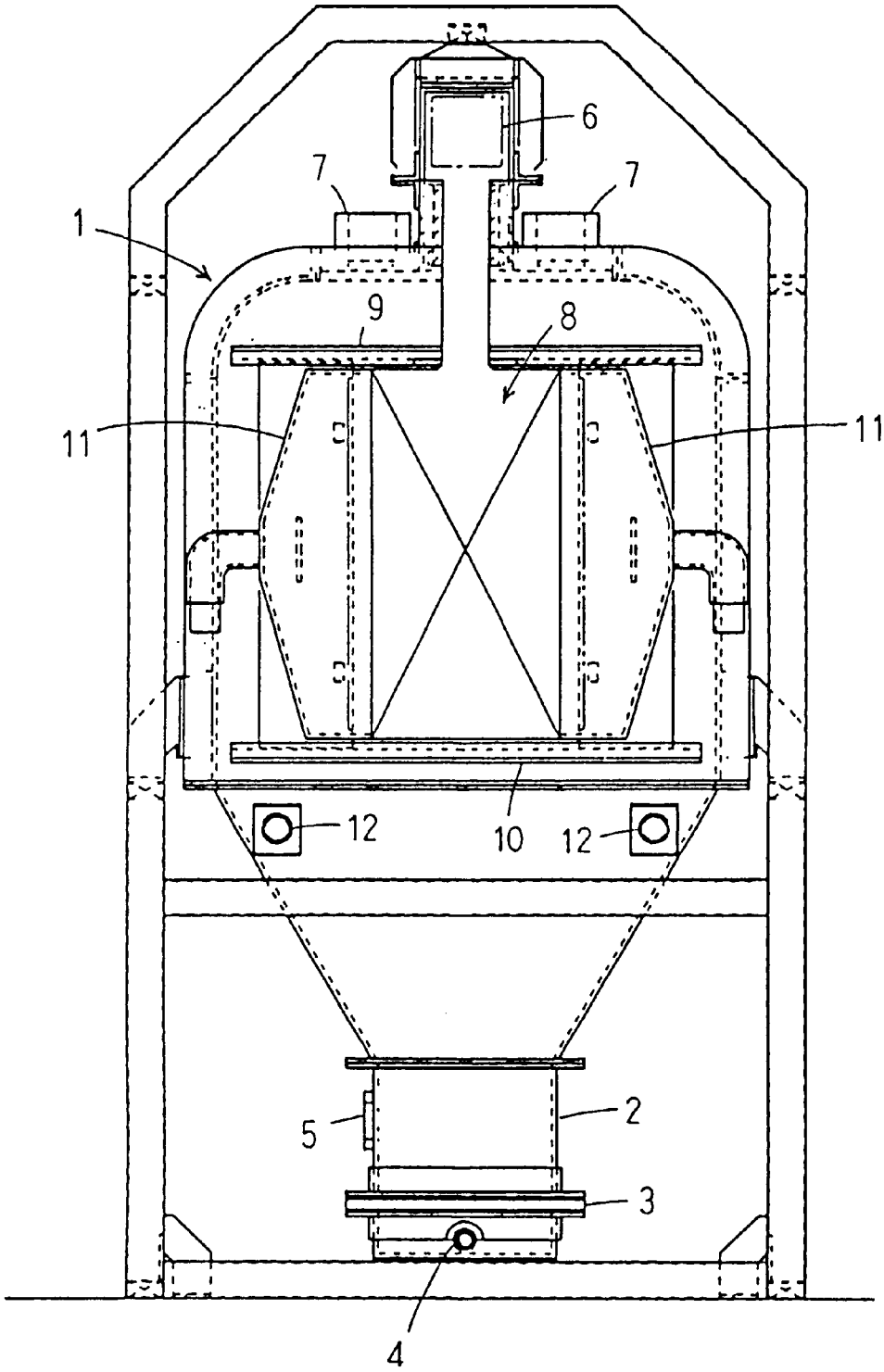
Figure 3:
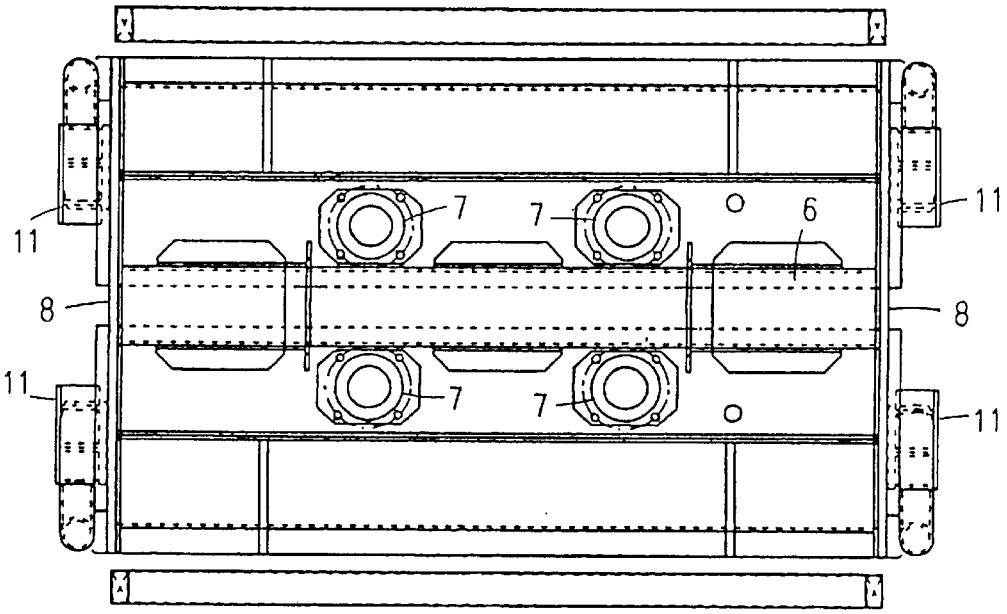

FIGS. 1 to 3 show a powder coating apparatus according to an embodiment of the present invention. A booth 1 has its lower portion shaped like an inverted pyramid with its sectional area reduced in a downward direction, and a fluidized bed unit 2 for fluidizing a powder coating material is detachably attached to the bottom of the booth 1. The fluidized bed unit 2 has an opening on the top thereof so as to communicate with the booth 1, and is divided into an upper chamber and a lower chamber with a porous plate 3. Compressed air is supplied to the lower chamber through an air introducing port 4. Four injector attaching ports 5 are formed on a side wall of the upper chamber.

A conveyor 6 is mounted on the booth 1 so as to extend in a longitudinal direction of the booth 1. The conveyor 6 transfers an object to be coated within the booth 1 while holding the object thereon. On the top of the booth 1 are four flanges 7, which are arranged so as to interpose the conveyor 6 therebetween and which correspond to the injector attaching ports 5. Openings 8 serving as an entrance and an exit for the object to be coated, respectively, are formed at both ends in the longitudinal direction of the booth 1. The width of each opening 8 can be adjusted by a corresponding pair of sucking hoods 11 that is arranged so as to be movable horizontally along an upper rail 9 and a lower rail 10. Each sucking hood 11 serves to suck the air in the vicinity of the openings 8.

A pair of tubular ejectors 12 is arranged at the lower portion of the booth 1 so as to extend in the longitudinal direction of the booth 1. Each ejector 12 has a plurality of upwardly facing air blowing nozzles 13. Further, a pair of opposing rectangular electrode plates 14 is suspended from the top of the booth 1 so as to extend in the longitudinal direction of the booth 1. An inspection window 15 is provided on a side wall of the booth 1 so as to be opened and closed.

Figure 4:
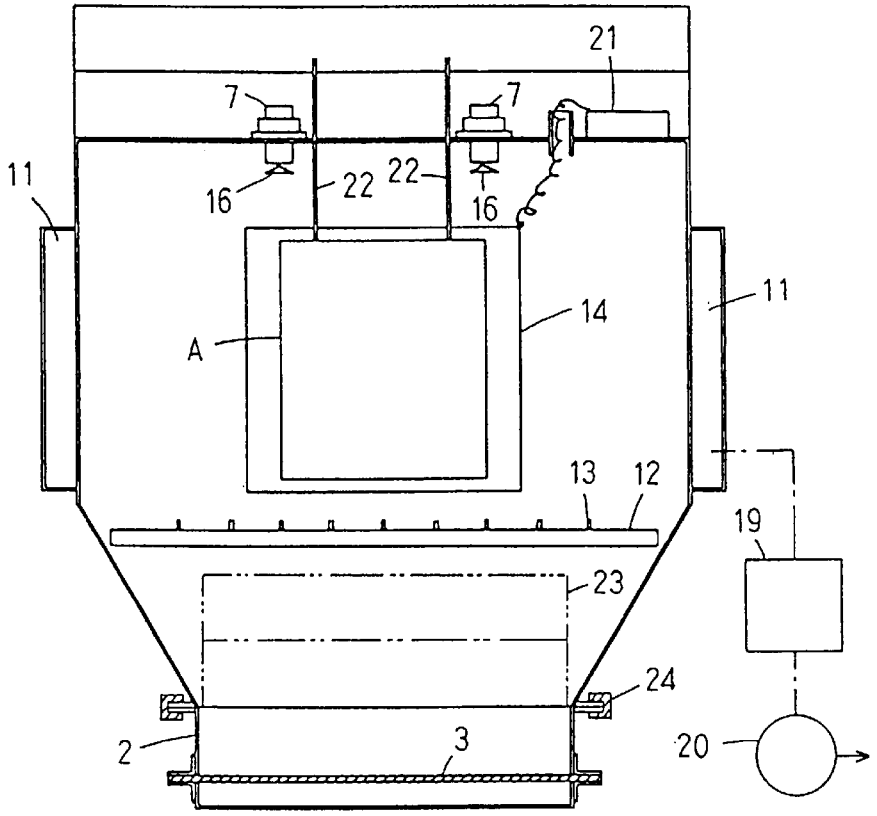
FIGS. 4 and 5 are a front sectional view and a side sectional view each, respectively, showing the internal structure of the powder coating apparatus shown in FIGS. 1 to 3.
Figure 5:
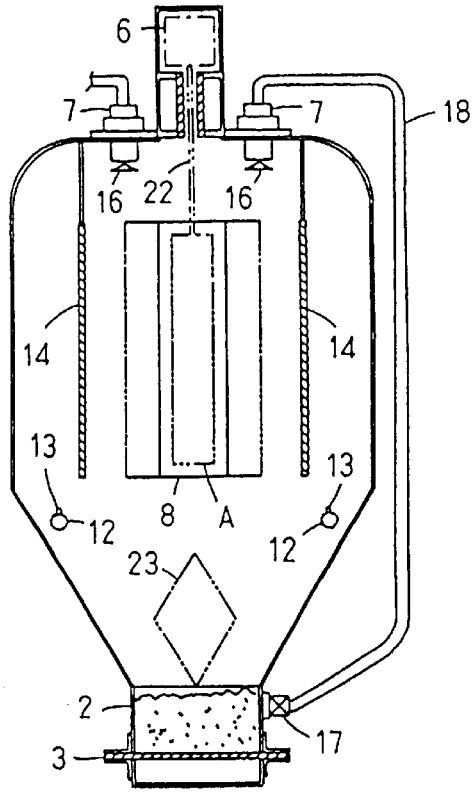

As shown in FIGS. 4 and 5, the four flanges 7 arranged on the top of the booth 1 communicate with downwardly facing coating material blowing nozzles 16 that are attached to a ceiling of the booth 1, respectively. While the respective coating material blowing nozzles 16 may have the function of scattering the powder coating material into the booth 1, they may also have the function of charging the powder coating material by virtue of frictional electrification or internal corona electrification. Further, injectors 17 are attached to the four injector attaching ports 5 of the fluidized bed unit 2, and connected to the corresponding flanges 7 on the top of the booth 1 through coating material hoses 18,respectively. A sucking fan 20 is connected to the sucking hoods 11 at both ends in the longitudinal direction of the booth 1 through a bag filter 19. Further, a high-voltage power supply 21 arranged on the top of the booth 1 is electrically connected to the respective electrode plates 14. The object to be coated A is held within the booth 1 while suspended by hangers 22 that can be transferred by the conveyor 6. The object to be coated A is electrically grounded through the hangers 22 and the conveyor 6. Further, a rectifying unit 23 is arranged immediately above the fluidized bed unit 2 within the booth 1. The unit 23 is made by forming a plate material into a rhomboidal cross section. The fluidized bed unit 2 is detachably attached to the bottom of the booth 1 through attaching pieces 24.

In the present invention, the injectors 17, the coating material hoses 18 and the coating material blowing nozzles 16 constitute the coating material blowing structure, the conveyor 6 and the hangers 22 constitute the holding structure, and the sucking hoods 11, the bag filter 19 and the sucking fan 20 constitute sucking structure.

Next, the operation of the powder coating apparatus according to this embodiment will be described. First, the fluidized bed unit 2, in which powder coating material is contained in the upper chamber formed on the porous plate 3, is attached to the bottom of the booth 1 through the attaching pieces 24. Then, compressed air is supplied to the lower chamber of the fluidized bed unit 2 from a not shown compressed air supply unit through the air introducing port 4. The compressed air supplied to the lower chamber is purged via the porous plate 3 into the upper chamber in which the powder coating material is contained, thereby fluidizing the powder coating material. When compressed air is supplied to the respective injectors 17 from a not shown compressed air supply unit, the powder coating material being fluidized within the upper chamber of the fluidized bed unit 2 is introduced into the coating material hoses 18, so that the powder coating material is blown into the booth 1 from the four coating material blowing nozzles 16. Further, compressed air is supplied to the pair of ejectors 12 from a not shown compressed air supply unit and purged upward from the plurality of air blowing nozzles 13, so that a circulating stream of the powder coating material is formed within the booth 1.

As a result, the powder coating material blown into the booth 1 from the coating material blowing nozzles 16 circulates within the booth 1 while riding on the circulating stream. At this instance, particles of the powder coating material that have failed to ride on the circulating stream fall down by their own weight, and thus returned to the upper chamber of the fluidized bed unit 2. While the compressed air supplied into the fluidized bed unit 2 from the air introducing port 4 is blown into the booth 1 after having fluidized the powder coating material, the compressed air has its flow rectified in the direction of the pair of ejectors 12 by the rectifying unit 23, thereby encouraging the formation of the circulating stream.

By driving the conveyor 6, the object to be coated A suspended by the hangers 22 is transferred into the booth 1 whose atmosphere is as described above, and a predetermined electric field is produced between the electrode plates 14 and the surface of the electrically grounded object to be coated A by causing the high-voltage power supply 21 to apply a potential from −20 to −50 kV. Particles of the powder coating material floating and circulating while riding on the circulating stream within the booth 1 adhere to the surface of the object to be coated A by receiving an electrostatic force from the electric field.

Further, by driving the sucking fan 20, the air in the vicinity of the openings 8 at both ends in the longitudinal direction of the booth 1 is sucked into the bag filter 19 from the sucking hoods 11. As a result, the particles of the powder coating material floating within the booth 1 are sucked from the sucking hoods 11 via the openings 8 and then entrapped by the bag filter 19 without being scattered outside the booth 1. Therefore, peripheral equipment and the like outside the booth 1 can be prevented from being soiled by the powder coating material.

The fluidized bed unit 2 is detachably attached to the bottom of the booth 1 by the attaching pieces 24. Therefore, when changing the coating color, a user removes the fluidized bed unit 2 from the booth 1, and cleans the booth 1 by air blowing or the like. And thereafter the user attaches a new fluidized bed unit 2, which contains a powder coating material whose color is different and with which the user wishes to coat an object, to the bottom of the booth 1. Then, next coating operation can be performed.

Note that suitable wall materials for the booth 1 are plastic materials such as vinyl chloride, polyethylene, acryl and polycarbonate.

Figure 6:
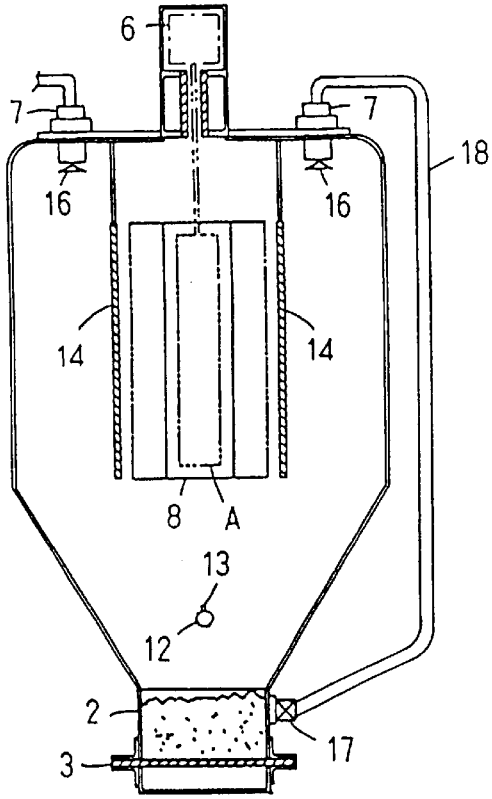
FIG. 6 is a side sectional view showing the internal structure of a powder coating apparatus according to another embodiment of the present invention.

In the aforementioned embodiment, as shown in FIG. 5, the upwardly facing air blowing nozzles 13 are located outside and below the pair of electrode plates 14 and the downwardly facing coating material blowing nozzles 16 are located inside and above these electrode plates 14, and the circulating stream of the coating material is formed so that the stream comes down along the surface of the object to be coated A and rises up outside the pair of electrode plates 14. However, the present invention is not limited to this embodiment. For example, it may be so arranged as shown in FIG. 6 that the upwardly facing air blowing nozzles 13 are located immediately below the object to be coated A that is interposed between the pair of electrode plates 14, and the downwardly facing coating material blowing nozzles 16 are located outside and above these electrode plates 14, and a circulating stream is formed so that the stream rises up along the surface of the object to be coated A and comes down outside the pair of electrode plates 14.

As described in the foregoing, according to the present invention, a fluidized powder coating material is blown into the booth from the top of the booth, and a circulating stream of the powder coating material is formed within the booth. Therefore, the powder coating material does not become classified, thus allowing particles of the powder coating material having large sizes to contribute to the formation of a film. As a result, the use efficiency of the powder coating material can be improved.

What is claimed is:

1. A powder coating apparatus comprising:

a booth having a coating space and a bottom at which is to be formed a fluidized bed of a powder coating material;

a coating material blower having an opening at a top of said coating space, said coating material blower to receive the powder coating material from the fluidized bed and blow the received powder coating material into said coating space from said opening at the top of said coating space;

a holder to hold an object to be coated within said coating space by the powder coating material;

electrodes positioned within said coating space and positioned on opposite sides of the object when the object is held by said holder;

a power supplier to supply a high voltage between said electrodes and the object when the object is held by said holder; and circulating stream forming structure to form a circulating stream of the powder coating material within said coating space.

2. The powder coating apparatus according to claim 1, and further comprising a fluidized bed unit that is detachably attachable to said booth, wherein the fluidized bed of the powder coating material is to be formed within said fluidized bed unit.

3. The powder coating apparatus according to claim 2, wherein said circulating stream forming structure includes ejectors to blow air upwardly from a lower portion of said booth.

4. The powder coating apparatus according to claim 3, and further comprising a rectifying unit, to be arranged immediately above the fluidized bed of the powder coating material, to cause a stream of the powder coating material to change direction.

5. The powder coating apparatus according to claim 4, wherein said booth further has longitudinally spaced ends, with an opening in each of said longitudinally spaced ends, wherein said holder is to move the object in the longitudinal direction while the object is being held by said holder such that the object is allowed to pass through said booth via the openings in said longitudinally spaced ends, and wherein said holder is to electrically ground the object.

6. The powder coating apparatus according to claim 5, and further comprising a sucker to suck air from said openings, and a bag filter to entrap the powder coating material contained in the air sucked by said sucker.

7. The powder coating apparatus according to claim 1, wherein said circulating stream forming structure is to form a circulating stream of the powder coating material that travels down along the object and up along an outer side of one of said electrodes.

8. The powder coating apparatus according to claim 7, wherein said circulating stream forming structure includes ejectors to blow air upwardly from a lower portion of said booth along the outer side of the one of said electrodes, and also includes said coating material blower to blow the powder coating material downwardly from an upper portion of said booth along the object.

9. The powder coating apparatus according to claim 1, wherein said circulating stream forming structure is to form a circulating stream of the powder coating material that travels up along the object and down along an outer side of one of said electrodes.

10. The powder coating apparatus according to claim 9, wherein said circulating stream forming structure includes ejectors to blow air upwardly from a lower portion of said booth along the object, and also includes said coating material blower to blow the powder coating material downwardly from an upper portion of said booth along the outer side of the one of said electrodes.

11. The powder coating apparatus according to claim 1, wherein said booth further has longitudinally spaced ends, with an opening in each of said longitudinally spaced ends, wherein said holder is to move the object in the longitudinal direction while the object is being held by said holder such that the object is allowed to pass through said booth via the openings in said longitudinally spaced ends, and wherein said holder is to electrically ground the object.

12. The powder coating apparatus according to claim 11, and further comprising a sucker to suck air from said openings, and a bag filter to entrap the powder coating material contained in the air sucked by said sucker.

13. The powder coating apparatus according to claim 1, wherein said material blower is to blow the powder coating material in a downwardly extending direction toward the bottom of said booth.

14. The powder coating apparatus according to claim 1, wherein said circulating stream forming structure includes ejectors to blow air upwardly from a lower portion of said booth.

15. The powder coating apparatus according to claim 1, and further comprising a rectifying unit, to be arranged immediately above the fluidized bed of the powder coating, to cause a stream of the powder coating material to change direction.

16. A powder coating method comprising:

fluidizing powder coating material at a bottom of a booth having a coating space;

blowing the fluidized powder coating material into said coating space from an opening at a top of said coating space;

forming a circulating stream of said powder coating material within said coating space;

introducing an object into said coating space; and producing an electric field around said object, whereby said powder coating material is caused to electrostatically adhere to said object.

17. The method according to claim 16, wherein said electric field is produced by supplying a voltage to electrodes positioned on opposite sides of said object.

18. The method according to claim 17, wherein the formation of the circulating stream includes blowing air upwardly from a lower portion of said booth along an outer side of one of said electrodes, and also includes blowing the powder coating material downwardly from an upper portion of said booth along said object.

19. The method according to claim 17, wherein the formation of the circulating stream includes blowing air upwardly from a lower portion of said booth along said object, and also includes blowing the powder coating material downward from the upper portion of said booth along an outer side of one of said electrodes.

20. The method according to claim 16, and further comprising passing said object through said booth by moving said object in a longitudinal direction of said booth.

21. The method according to claim 20, and further comprising sucking air from longitudinally spaced sides of said booth to thereby entrap the powder coating material contained in the sucked air.

22. The method according to claim 16, wherein the formation of the circulating stream includes blowing air upwardly from a lower portion of said booth.

23. The method according to claim 16, wherein the blowing of the fluidized powder coating material into said coating space comprises blowing said fluidized powder coating material in a downwardly extending direction.

* * * * *